US011234577B2

(12) United States Patent
Durham et al.

(10) Patent No.: US 11,234,577 B2
(45) Date of Patent: Feb. 1, 2022

(54) SYSTEM AND METHOD FOR CALIBRATING A WASH FLUID LEVEL DETECTION SYSTEM IN A DISHWASHER APPLIANCE

(71) Applicant: Haier US Appliance Solutions, Inc., Wilmington, DE (US)

(72) Inventors: Kyle Edward Durham, Louisville, KY (US); Christopher Brandon Ross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 23 days.

(21) Appl. No.: 16/748,886

(22) Filed: Jan. 22, 2020

(65) Prior Publication Data

US 2021/0219812 A1 Jul. 22, 2021

(51) Int. Cl.
*A47L 15/42* (2006.01)
*A47L 15/00* (2006.01)

(52) U.S. Cl.
CPC ..... *A47L 15/4244* (2013.01); *A47L 15/0023* (2013.01); *A47L 15/4217* (2013.01); *A47L 15/4297* (2013.01); *A47L 2401/06* (2013.01); *A47L 2401/09* (2013.01); *A47L 2401/14* (2013.01)

(58) Field of Classification Search
CPC ..... A47L 15/0023; A47L 15/4244; A47L 2401/09; A47L 2401/14; D06F 39/087; D06F 2103/18; D06F 2202/08; G01F 25/0061; G01F 25/0076; G01F 25/0084
See application file for complete search history.

(56) References Cited

U.S. PATENT DOCUMENTS

| | | | | |
|---|---|---|---|---|
| 8,845,813 | B2 | 9/2014 | Pers et al. | |
| 9,936,852 | B2 | 4/2018 | Forst et al. | |
| 2005/0140359 | A1* | 6/2005 | Bindocci | G01L 9/007 324/207.15 |
| 2005/0166334 | A1* | 8/2005 | Clouser | D06F 33/34 8/159 |
| 2013/0008477 | A1* | 1/2013 | Forst | A47L 15/0023 134/57 D |
| 2019/0179350 | A1 | 6/2019 | Durham | |

FOREIGN PATENT DOCUMENTS

| | | | | |
|---|---|---|---|---|
| DE | 19933807 | A1 * | 2/2001 | D06F 34/14 |
| EP | 1072968 | A2 * | 1/2001 | G01F 25/0061 |
| EP | 2065508 | A1 * | 6/2009 | A47L 15/4244 |
| EP | 2228484 | A1 * | 9/2010 | D06F 39/087 |

OTHER PUBLICATIONS

DE19933807—Machine Translation (Year: 2001).*

* cited by examiner

*Primary Examiner* — Marc Lorenzi
(74) *Attorney, Agent, or Firm* — Dority & Manning, P.A.

(57) ABSTRACT

A dishwasher appliance includes a sump that defines a transition fill level where the cross sectional area of the sump increases. A pressure sensor is operably coupled to the sump for monitoring sump pressure and wash fluid level. A controller calibrates the pressure sensor by monitoring a sump pressure and determining when the wash fluid has reached the transition fill level. A measured transition pressure is taken at this point and compared to a target transition pressure that is known based on the sump geometry. A slope correction factor is calculated based on the measured transition pressure and the target transition pressure to obtain improved pressure readings and wash fluid level measurements.

18 Claims, 6 Drawing Sheets

SYSTEM AND METHOD FOR CALIBRATING A WASH FLUID LEVEL DETECTION SYSTEM IN A DISHWASHER APPLIANCE

FIELD OF THE INVENTION

The present disclosure relates generally to dishwasher appliances, and more particularly to the calibration of water level detection systems within dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a drain pump may periodically discharge soiled wash fluid that collects in the sump space and the process may be repeated.

Conventional dishwasher appliances may include a sump for collecting wash fluid and water level detection systems for detecting the amount or level of wash fluid within the sump. For example, water level detection systems may include one or more pressure sensors operably coupled to the sump for measuring a pressure of the wash fluid and determining a wash fluid level. However, over time, drift in the output of such pressure sensors may result in erroneous pressure readings and water level measurements. Failure to compensate for such variations in pressure readings can result in overfilling or underfilling the sump and decreased wash performance.

Accordingly, a dishwasher appliance having improved features for determining the water level in the sump would be desirable. More specifically, a dishwasher appliance with an improved water level detection system would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance defining a vertical direction is provided and includes a wash tub that defines a wash chamber, a sump for collecting wash fluid, the sump defining a transition fill level, a pressure sensor operably coupled to the sump, and a controller operably coupled to the pressure sensor. The controller is configured for monitoring a sump pressure using the pressure sensor, determining, based on the sump pressure, that the wash fluid has reached the transition fill level, obtaining a measured transition pressure that is equal to the sump pressure when the wash fluid has reached the transition fill level, obtaining a target transition pressure, and determining a slope correction factor based on the measured transition pressure and the target transition pressure.

In a second example embodiment, a method for calibrating a pressure sensor of a dishwasher appliance is provided. The dishwasher appliance includes a sump for collecting wash fluid, the sump defining a transition fill level, and a pressure sensor operably coupled to the sump. The method includes monitoring a sump pressure using the pressure sensor, determining, based on the sump pressure, that the wash fluid has reached the transition fill level, obtaining a measured transition pressure that is equal to the sump pressure when the wash fluid has reached the transition fill level, obtaining a target transition pressure, and determining a slope correction factor based on the measured transition pressure and the target transition pressure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
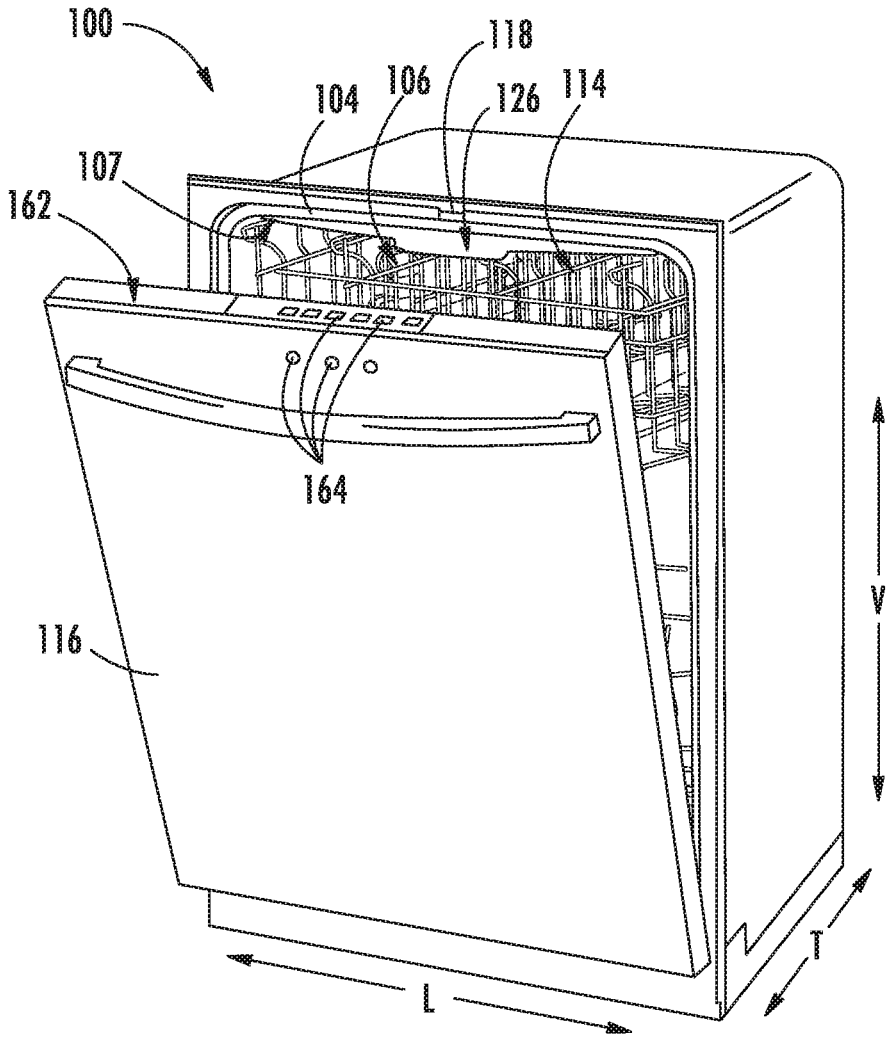
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
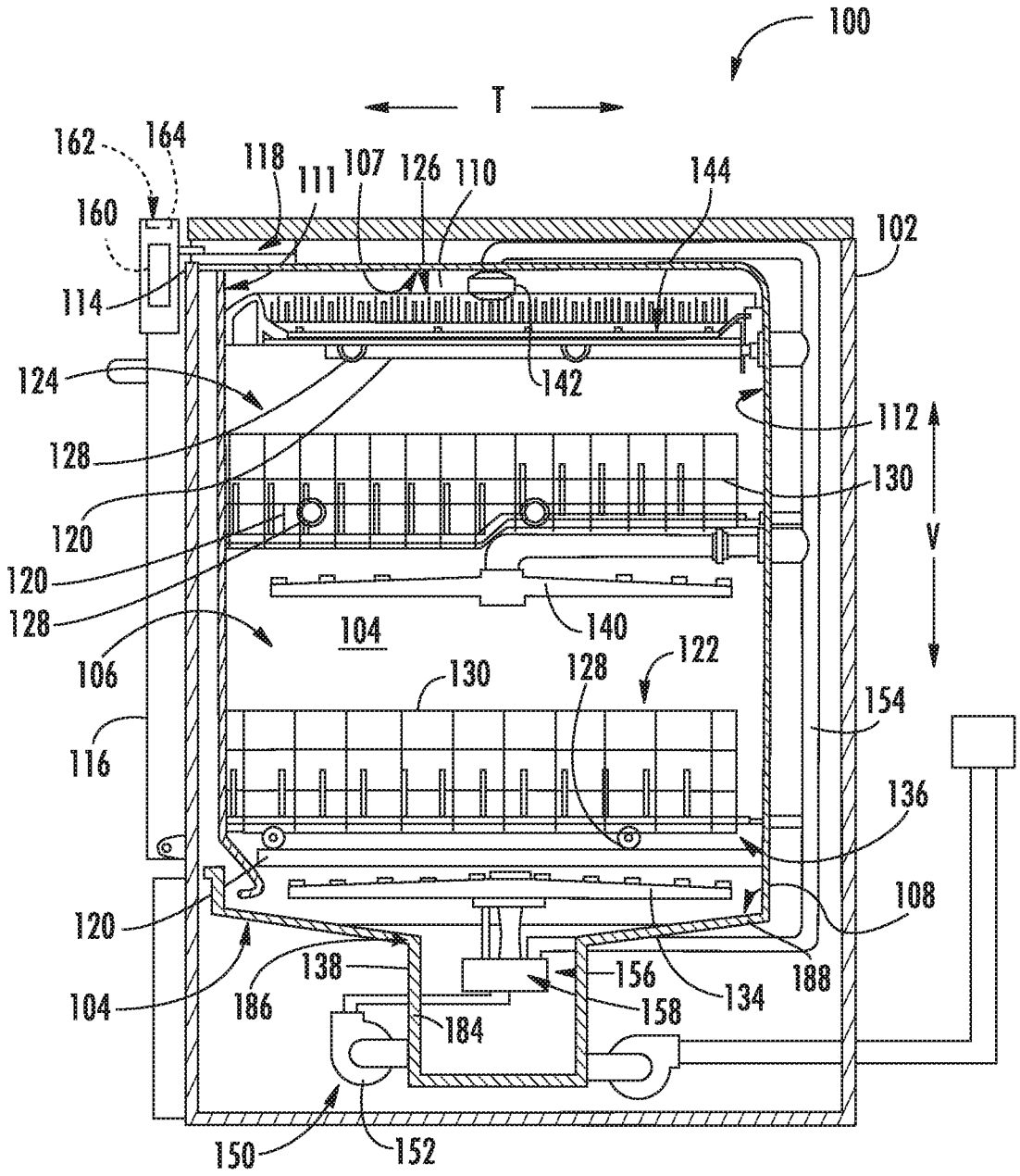
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds, e.g., during wash and/or rinse cycles. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
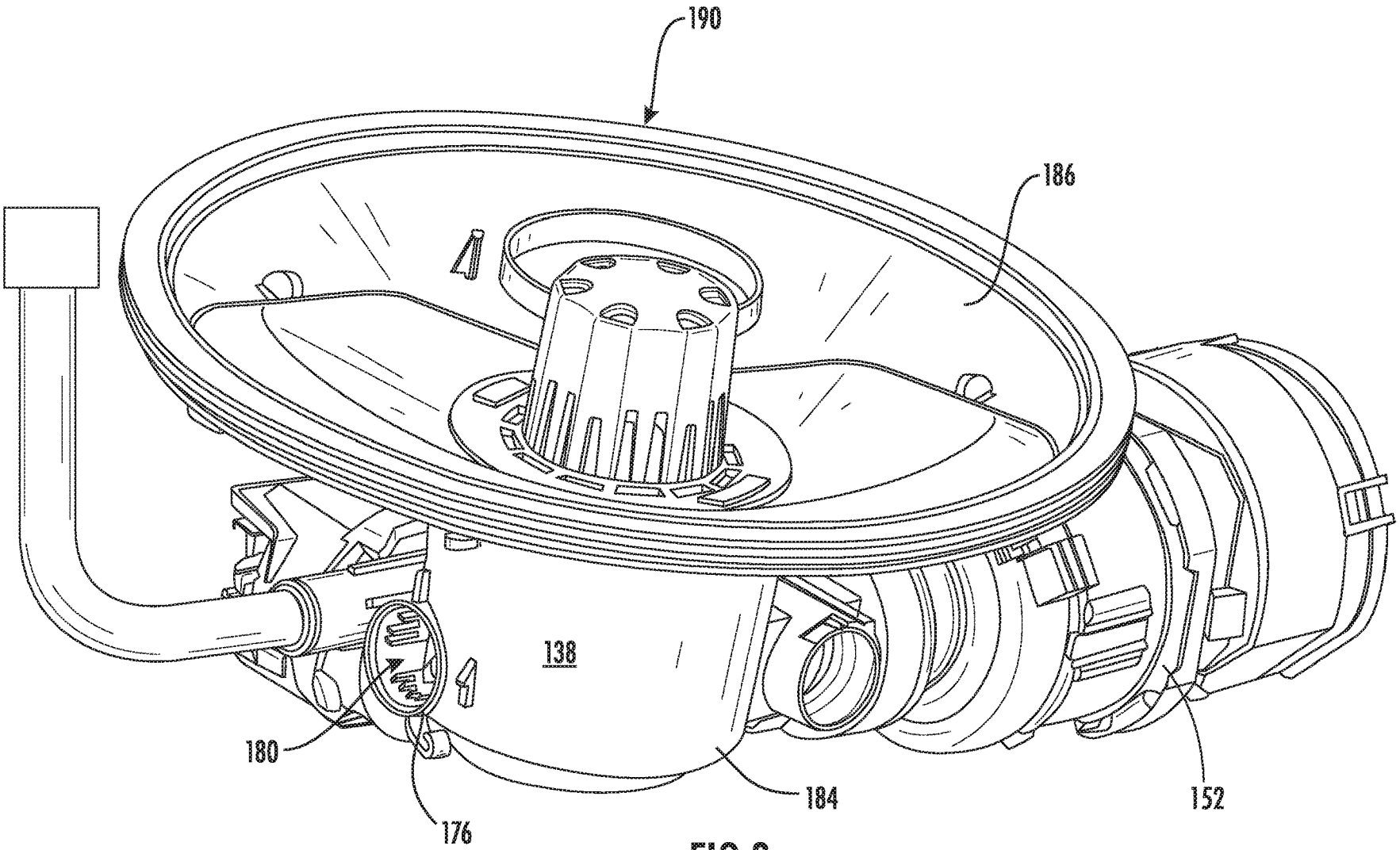
FIG. 3 provides a perspective view of a sump assembly of the exemplary dishwashing appliance of FIG. 1 according to an example embodiment of the present subject matter.
Figure 4:
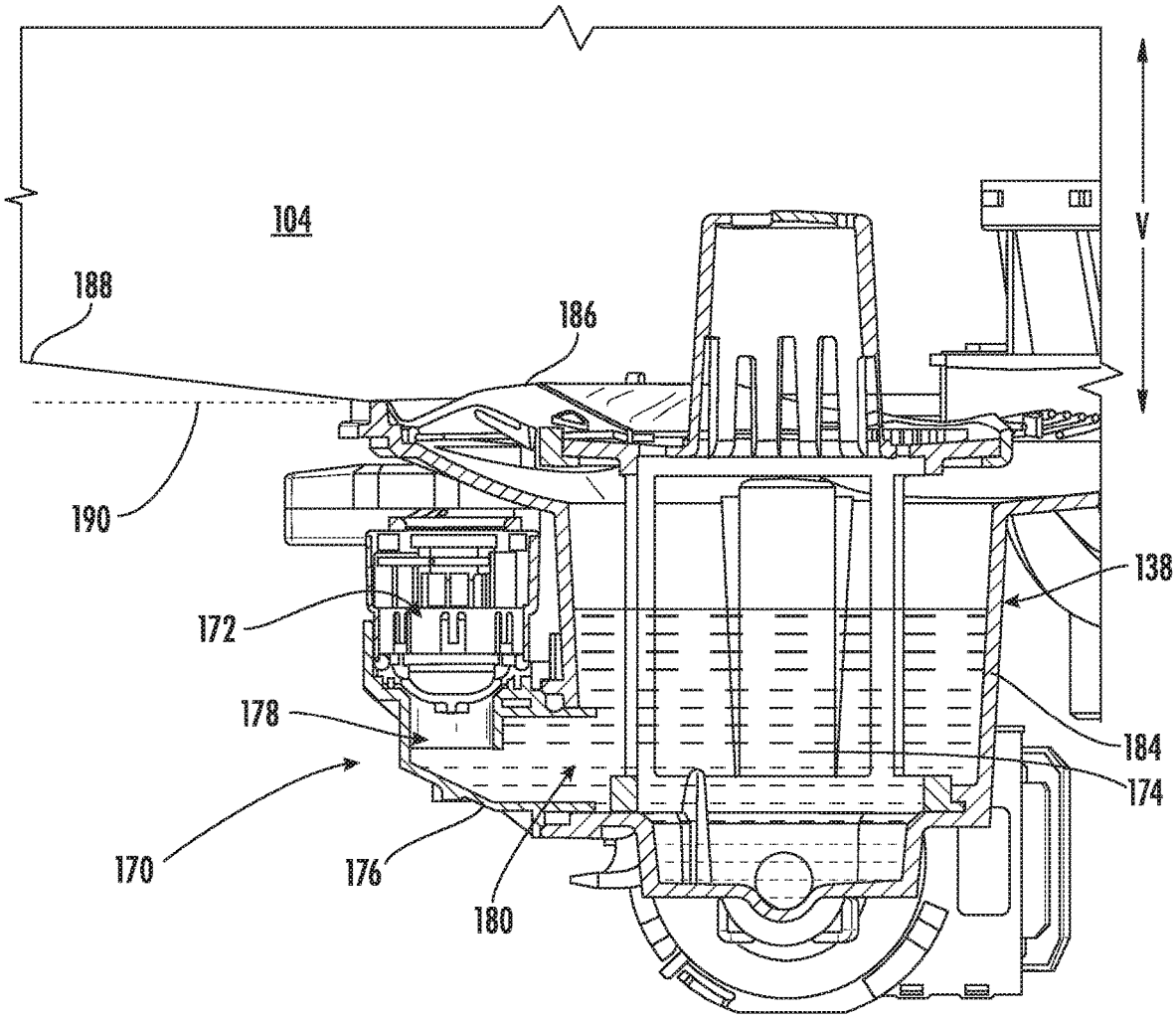
FIG. 4 provides a cross sectional view of the exemplary sump assembly of FIG. 3.

Referring now generally to FIGS. 3 and 4, a water level detection system 170 according to an exemplary embodiment of the present subject matter will be described. Water level detection system 170 may generally be configured for continuously or periodically measuring a level of water or wash fluid within dishwasher 100. Water level detection system 170 described herein is only one exemplary configuration used for the purpose of explaining aspects of the present subject matter and is not intended to limit the scope of the invention in any manner.

As illustrated, a water level detection system 170 includes a pressure sensor 172 operably coupled to sump 138 for measuring a pressure of wash fluid 174 (see FIG. 4) within sump 138 to facilitate wash fluid level detection. According to the illustrated embodiment, pressure sensor 172 is mounted to a receiving boss 176 defined by sump 138. More specifically, receiving boss 176 may further define an air chamber 178 that provides a vertical gap between pressure sensor 172 and the level of wash fluid 174 within receiving boss 176, e.g., to prevent contamination or fouling of pressure sensor 172.

In general, pressure sensor 172 may be any sensor suitable for determining a water level within sump 138 based on pressure readings. For example, pressure sensor 172 may be a piezoelectric pressure sensor and thus may include an elastically deformable plate and a piezoresistor mounted on the elastically deformable plate. However, it should be appreciated that according to alternative embodiments, pressure sensor 172 may be any type of pressure sensor that is fluidly coupled to sump 138 in any other suitable manner for obtaining sump pressures to facilitate water level detection.

Water level detection system 170 and pressure sensor 172 generally operate by measuring a pressure of air within air chamber 178 and using the measured chamber pressure to estimate the water level in sump 138. For example, when the water level within sump 138 falls below a chamber inlet 180, the pressure within air chamber 180 normalizes to ambient or atmospheric pressure, and thus reads a zero pressure. However, when water is present in sump 138 and rises above chamber inlet 180, the measured air pressure becomes positive and may increase proportionally with the water level. Although sump 138 is described herein as containing water, it should be appreciated that aspects of the present subject matter may be used for detecting the level of any other suitable wash fluid or liquid in any other appliance.

Notably, aspects of the present subject matter are directed to improving the accuracy of water level detection system 170 based at least in part on the geometry of sump 138 and/or tub 104. For example, according to the illustrated embodiment, sump 138 is generally in the shape of an upright cylinder is mounted at a bottom of the tub 104. Thus, as best illustrated in FIG. 4, sump 138 includes a cylindrical sidewall 184 that extends substantially along the vertical direction V. In addition, sump 138 may define a transition shoulder 186 where cylindrical sidewalls 184 taper outward and merge into relatively flat bottom walls 188 of tub 104. Notably, the cross-sectional area of sump 138 (e.g., taken within a horizontal plane) may increase at or above transition shoulder 186, which may be referred to herein as the transition fill level 190 (see dotted line in FIGS. 4 and 6). As used herein, the term "transition fill level" is generally intended to refer to a vertical location within sump 138 or tub 104 where the fill geometry changes, e.g., in a manner that may be identified on a sump pressure curve or by otherwise monitoring sump pressure during a filling process.

As explained in further detail below, pressure sensor 172 may be used to detect the change in fill rate or sump pressure associated with the water level reaching transition shoulder 186 or the transition fill level 190 and this data can be used to calibrate and/or improve the accuracy of water level detection system 170. Specifically, due to this geometry, when a water valve is opened such that water or wash fluid 174 is provided into sump 138, the pressure measured by pressure sensor 172 increases in a manner that corresponds in part with the geometry of the sump 138 and tub 104. Thus, for example, if the flow of water is substantially constant, the measured pressure will increase in a substantially linear or proportional manner when the water level remains within the cylindrical sidewalls 184 of sump 138. After the wash fluid 174 breaches the top of the cylindrical sidewalls 184, i.e., at transition shoulder 186, the measured pressure will still increase, but at a slower rate. Aspects of the present subject matter are directed toward detecting that decrease in the water level fill rate. Then, because the geometry and fill volume required to reach transition shoulder 186 may be known or accurately determined, this fill volume and associated target pressure (referred to herein as the "target transition pressure") may be used to help calibrate pressure sensor 172, as will be described in more detail below.

Although a specific geometry of sump 138 and a corresponding sump pressure curve are illustrated herein for explaining aspects of the present subject matter, it should be appreciated that according to alternative embodiments other suitable sump geometries and pressure curves may be used while remaining within the scope of the present subject matter. In this regard, for example, any change in sump geometry that generates a detectable pressure difference during a fill cycle may be used to calibrate pressure sensor 172. For example, according to alternative embodiments, sump 138 may define a necked or narrowed region within sump 138 where there is an identifiable increase in the fill rate.

Now that the construction of dishwasher appliance 100 and the configuration of controller 160 according to exemplary embodiments have been presented, an exemplary method 200 of operating a dishwasher appliance will be described. Although the discussion below refers to the exemplary method 200 of operating dishwasher appliance 100, one skilled in the art will appreciate that the exemplary method 200 is applicable to the operation of a variety of other dishwasher appliances or other suitable appliances. In exemplary embodiments, the various method steps as disclosed herein may be performed by controller 160 or a separate, dedicated controller.

Figure 5:
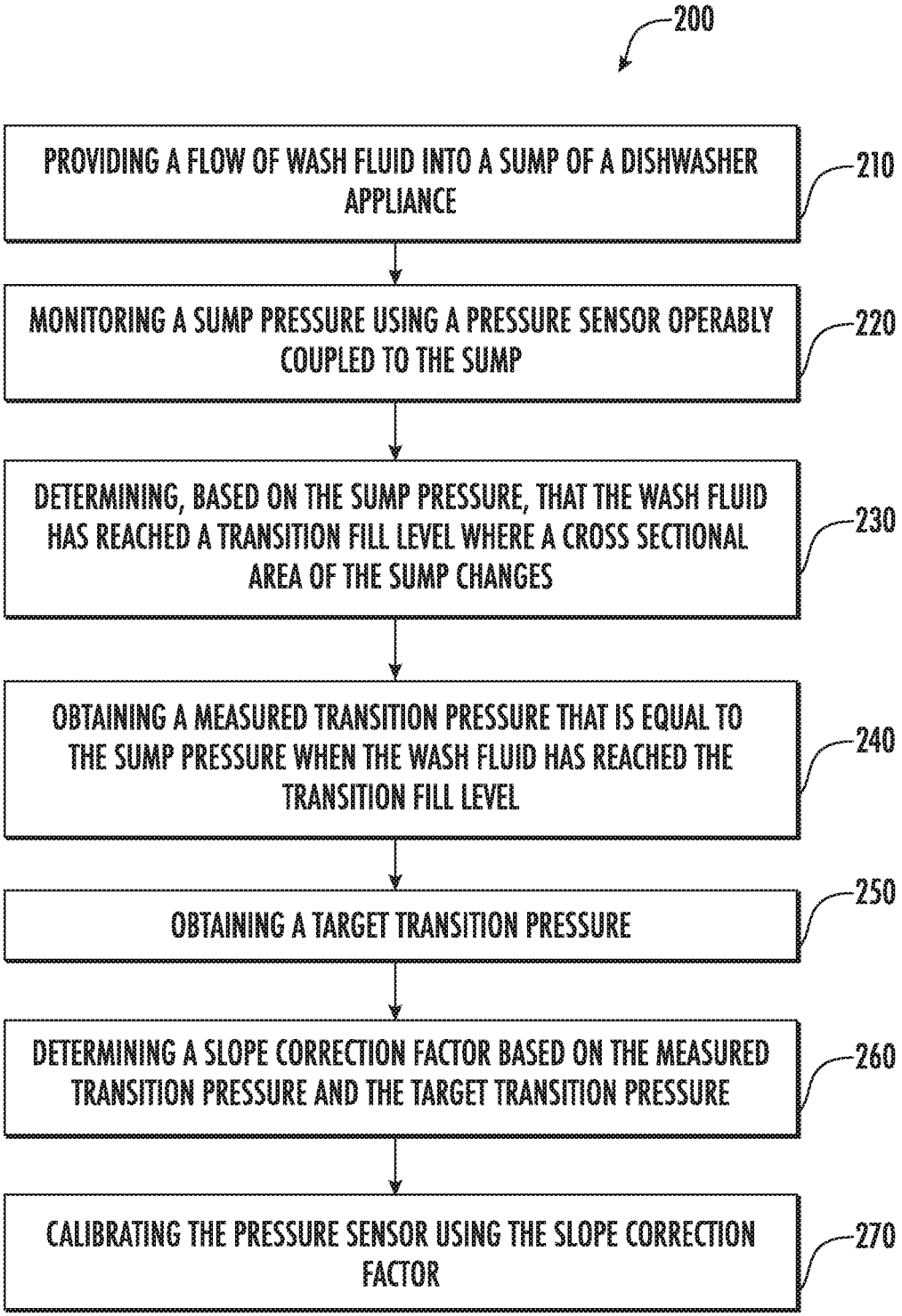
FIG. 5 provides a method of calibrating a water level detection system that may be used with the exemplary dishwasher appliance of FIG. 1 according to an exemplary embodiment.
Figure 6:
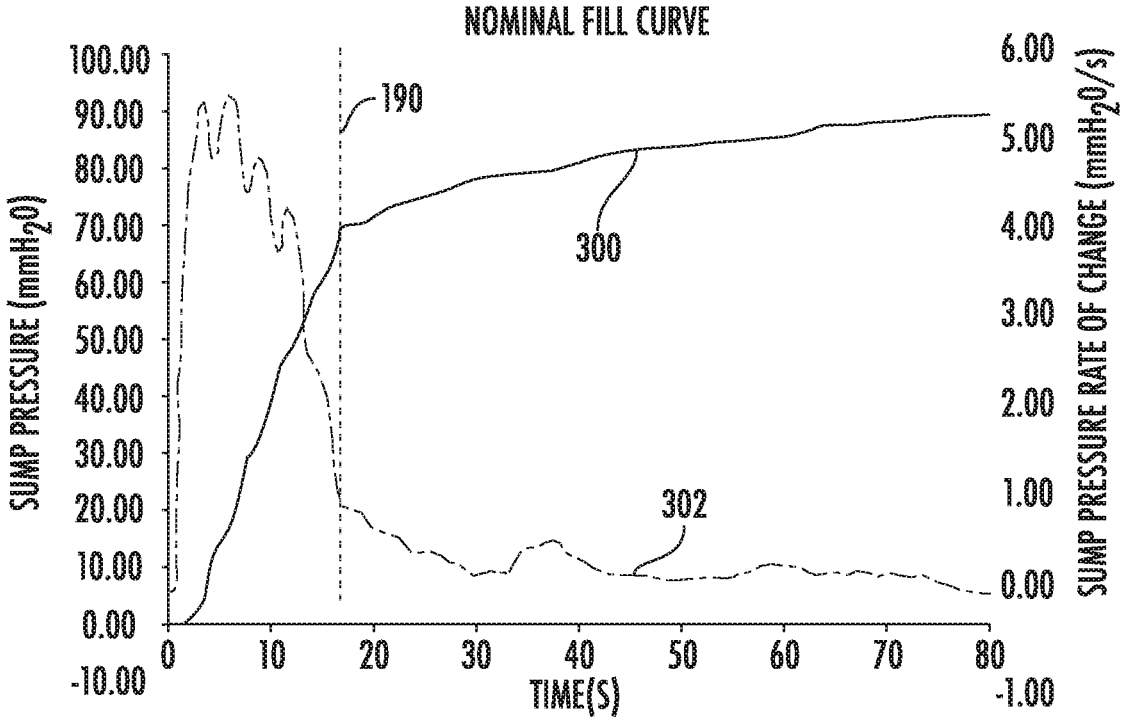
FIG. 6 is a plot of a sump pressure curve of the measured sump pressure over time during a fill cycle and the derivative of that sump pressure curve.

Referring now to FIG. 5, method 200 includes, at step 210, providing a flow of wash fluid into a sump of the dishwasher appliance. Step 220 includes monitoring a sump pressure using a pressure sensor operably coupled to the sump. In this regard, as explained above, pressure sensor 172 may be used to monitor a sump pressure, and controller 160 may be used to approximate the water level within sump 138 based on the measured sump pressure. Referring briefly to FIG. 6, an exemplary sump pressure curve 300 is illustrated which may correspond to the sump pressure within sump 138 during a fill process at a constant flow rate.

Step 230 includes determining, based on the sump pressure, that the wash fluid has reached the transition fill level where the cross sectional area of the sump changes. In this regard, continuing example from above, the transition fill level 190 may refer to the vertical height where cylindrical sidewalls 184 taper into bottom walls 188 of tub 104, e.g., at the transition shoulder 186. According to exemplary embodiments, determining that the wash fluid has reached the transition fill level may be manually determined by an operator or technician during a calibration process, or may be automatically determined using controller 160. In this regard, for example, controller 160 may obtain a first pressure reading and a second pressure reading a predetermined amount of time after the first pressure reading. Controller 160 may then determine that the transition fill level has been reached if a difference between the first pressure reading and the second pressure reading falls below a predetermined pressure difference. In this regard, based on the sump geometry and a known measurement frequency, controller 160 may know the wash fluid level based on the pressure difference of sequential pressure readings.

According to alternative embodiments, determining that the wash fluid has reached the transition fill level may be based on a sump pressure curve 300, e.g., a plot of sump pressure over time during a fill cycle. In this regard, for example, the transition fill level may be identified by taking a first derivative of the sump pressure curve and determining that the first derivative of the sump pressure curve falls below a threshold rate. For example, referring to FIG. 6, the first derivative of sump pressure curve 300 is identified by reference numeral 302. In addition, the point when the water level reaches the transition fill level 190 is identified by the vertical dotted line (labeled 190). Therefore, controller 160 may determine that the transition fill level has been reached when the first derivative 302 falls below a threshold rate, e.g., such as 1 mmH20 per second as shown in FIG. 6.

Figure 7:
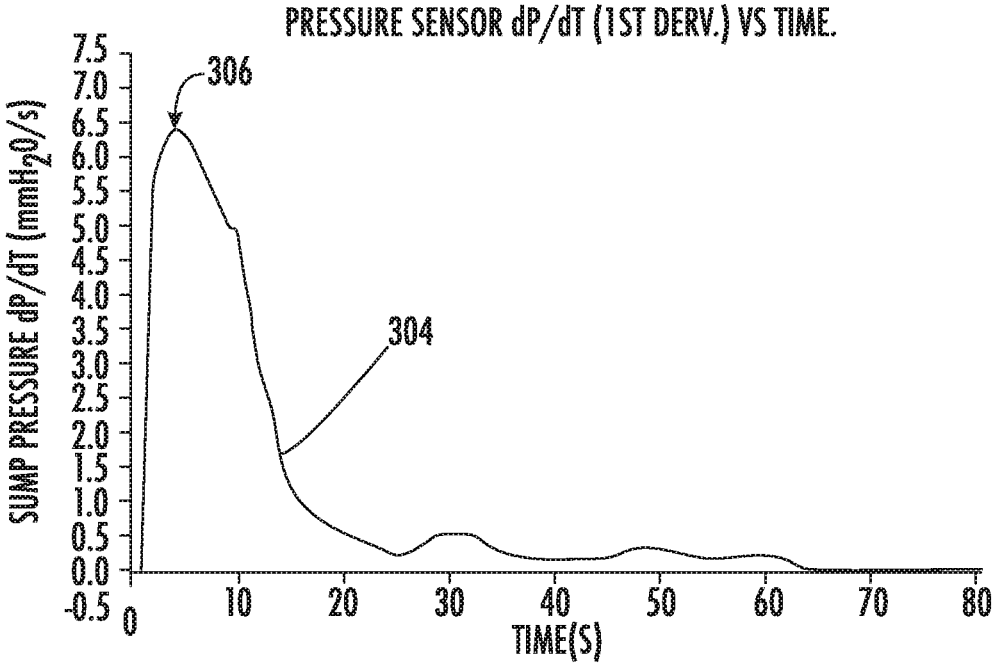
FIG. 7 is a plot of the second derivative of the sump pressure curve of FIG. 6 according to an exemplary embodiment of the present subject matter.

Referring now to FIG. 7, controller 160 may also determine that the transition fill level has been reached by looking at a second derivative 304 of a sump pressure curve. In this regard, FIG. 7 provides an exemplary second derivative curve 304 of an exemplary sump pressure curve. Controller 160 may identify a local maximum 306 of the second derivative curve 304 and this point may correspond to the time when the transition fill level has been reached. Although the examples above identify the transition fill level based on a change of pressure slope that falls below a predetermined threshold, it should be appreciated that according to alternative embodiments any other variation in the sump pressure curve may be used to identify a specific sump geometry or location and that variation may be used to identify a fill volume and corresponding pressure for calibrating a pressure sensor 172. For example, according to an alternative embodiment, the transition fill level may be defined at a region of decreased cross-sectional area (e.g., a necked or narrowed portion defined by cylindrical sidewalls 184) and the transition fill level may be identified by determining where the change of slope of the sump pressure curve increases, e.g., due to the sump geometry.

Notably, variations and modifications to the determination of the transition fill level may be used while remaining within the scope of the present subject matter. For example, as illustrated in FIGS. 6 and 7, controller 160 may store a sump pressure curve 300 over the entire fill cycle, with measurements being taken every second or at any other suitable frequency. However, according to alternative embodiments, controller 160 may store a rolling queue of pressure readings, e.g., such as the last 10 pressure readings, with one pressure reading being taken every second.

Referring again to FIG. 5, method 200 may include, at step 240, obtaining a measured transition pressure that is equal to the sump pressure when the wash fluid has reached the transition fill level. In this regard, continuing example from above, when the transition fill level is identified (e.g., at step 230), controller 160 may determine what the sump pressure measurement from pressure sensor 172 is at that moment. Step 250 may include obtaining a target transition pressure which corresponds to a known and accurate pressure when sump 138 is filled to the transition fill level 190. Step 260 includes determining a slope correction factor based on the measured transition pressure and the target transition pressure. In this regard, by knowing what the sump pressure should be at the transition fill level 190 and what the actual measured pressure is at the transition fill level 190, controller 160 may calibrate or apply a scale factor to future sump pressure readings.

According to an exemplary embodiment, determining the slope correction factor may include using the following equation:

$$\text{Slope Correction Factor} = \frac{(P_{TARGET} - C_{OFFSET})}{P_{OUTPUT}}$$

where: $P_{TARGET}$=the target transition pressure;
$C_{OFFSET}$=a constant, positive pressure;
$P_{OUTPUT}$=the measured transition pressure; and
Slope Correction Factor=a dimensionless constant.

In this regard, the slope correction factor may be equal to a difference between the target transition pressure an empirically determined offset associated with a pressure sensor divided by the measured transition pressure. In general, the $C_{OFFSET}$ value is used to compensate for zero pressure errors from pressure sensor 172, e.g., to compensate for pressure readings other than zero when sump 138 is empty. It should be appreciated that according to alternative embodiments, this $C_{OFFSET}$ value may be removed from the equation or may be set to zero. Notably, such a calibration cycle may be performed periodically or upon command of a user or technician.

After the calibration process has been performed, controller may use the slope correction factor to improve the accuracy of sump pressure readings. For example, calibrated sump pressure readings may be determined using the following equation:

$$P_{CAL}=\text{Slope Correction Factor}\cdot P_{OUTPUT}+C_{OFFSET}$$

where: $P_{CAL}$=the calibrated sump pressure;
$C_{OFFSET}$=a constant, positive pressure;
$P_{OUTPUT}$=the measured transition pressure; and
Slope Correction Factor=a dimensionless constant.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dishwasher appliance 100 as an example, it should be appreciated that these methods may be applied to the operation of any suitable dishwasher, washing machine appliance, or other appliance where accurate water level detection is desirable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical direction, the dishwasher appliance comprising:
a wash tub that defines a wash chamber;
a sump for collecting wash fluid, the sump defining a transition fill level that corresponds to a height of a shoulder of the sump where a cross sectional area of the sump increases;
a pressure sensor operably coupled to the sump; and
a controller operably coupled to the pressure sensor, the controller being configured for:
providing a flow of the wash fluid into the sump;
monitoring a sump pressure using the pressure sensor;
determining, based on the sump pressure, that the wash fluid has reached the transition fill level;
obtaining a measured transition pressure that is equal to the sump pressure when the wash fluid has reached the transition fill level;
referencing a target transition pressure;
determining a slope correction factor based on the measured transition pressure and the target transition pressure; and
determining a calibrated pressure of the wash fluid in the sump using the slope correction factor and a predetermined zero pressure offset.

2. The dishwasher appliance of claim 1, wherein determining the slope correction factor comprises using the following equation:

$$\text{Slope Correction Factor} = \frac{(P_{TARGET} - C_{OFFSET})}{P_{OUTPUT}}$$

where: $P_{TARGET}$=the target transition pressure;
$C_{OFFSET}$=a constant, positive pressure;
$P_{OUTPUT}$=the measured transition pressure; and
Slope Correction Factor=a dimensionless constant.

3. The dishwasher appliance of claim 1, wherein determining that the wash fluid has reached the transition fill level comprises:
obtaining a first pressure reading;

obtaining a second pressure reading a predetermined amount of time after the first pressure reading; and determining that a difference between the first pressure reading and the second pressure reading falls below a predetermined pressure difference.

4. The dishwasher appliance of claim 1, wherein determining that the wash fluid has reached the transition fill level comprises:

obtaining a sump pressure curve of the sump pressure over time;

obtaining a first derivative of the sump pressure curve; and determining that the first derivative of the sump pressure curve falls below a threshold rate.

5. The dishwasher appliance of claim 1, wherein determining that the wash fluid has reached the transition fill level comprises:

obtaining a sump pressure curve of the sump pressure over time;

obtaining a second derivative of the sump pressure curve; and identifying a local maximum of the second derivative of the sump pressure curve.

6. The dishwasher appliance of claim 1, wherein determining that the wash fluid has reached the transition fill level comprises:

obtaining a sump pressure curve of the sump pressure over time; and determining that the sump pressure curve has a change of slope that falls below a predetermined lower threshold or exceeds a predetermined upper threshold.

7. The dishwasher appliance of claim 4, wherein the sump pressure curve comprises a rolling queue of a predetermined number of most recent pressure measurements.

8. The dishwasher appliance of claim 7, wherein the predetermined number of most recent pressure measurements comprises 10 pressure measurements taken at a rate of one measurement per second.

9. The dishwasher appliance of claim 1, wherein determining the calibrated pressure of the wash fluid in the sump comprises using the following equation:

$$P_{CAL}=\text{Slope Correction Factor}\cdot P_{OUTPUT}+C_{OFFSET}$$

where: $P_{CAL}$=the calibrated sump pressure;

$C_{OFFSET}$=a constant, positive pressure;

$P_{OUTPUT}$=the measured transition pressure; and

Slope Correction Factor=a dimensionless constant.

10. The dishwasher appliance of claim 1, wherein the controller is further configured for performing periodic calibration cycles, each calibration cycle determining a new slope correction factor.

11. A method for calibrating a pressure sensor of a dishwasher appliance, the dishwasher appliance comprising a sump for collecting wash fluid, the sump defining a transition fill level that corresponds to a height of a shoulder of the sump where a cross sectional area of the sump increases, a pressure sensor operably coupled to the sump, and a controller operably coupled to the pressure sensor, the method being performed by the controller and comprising:

providing a flow of the wash fluid into the sump;

monitoring a sump pressure using the pressure sensor;

determining, based on the sump pressure, that the wash fluid has reached the transition fill level;

obtaining a measured transition pressure that is equal to the sump pressure when the wash fluid has reached the transition fill level;

referencing a target transition pressure;

determining a slope correction factor based on the measured transition pressure and the target transition pressure; and determining a calibrated pressure of the wash fluid in the sump using the slope correction factor and a predetermined zero pressure offset.

12. The method of claim 11, wherein determining the slope correction factor comprises using the following equation:

$$\text{Slope Correction Factor}=\frac{(P_{TARGET}-C_{OFFSET})}{P_{OUTPUT}}$$

where: $P_{TARGET}$=the target transition pressure;

$C_{OFFSET}$=a constant, positive pressure;

$P_{OUTPUT}$=the measured transition pressure; and

Slope Correction Factor=a dimensionless constant.

13. The method of claim 11, wherein determining that the wash fluid has reached the transition fill level comprises:

obtaining a first pressure reading;

obtaining a second pressure reading a predetermined amount of time after the first pressure reading; and determining that a difference between the first pressure reading and the second pressure reading falls below a predetermined pressure difference.

14. The method of claim 11, wherein determining that the wash fluid has reached the transition fill level comprises:

obtaining a sump pressure curve of the sump pressure over time;

obtaining a first derivative of the sump pressure curve; and determining that the first derivative of the sump pressure curve falls below a threshold rate.

15. The method of claim 11, wherein determining that the wash fluid has reached the transition fill level comprises:

obtaining a sump pressure curve of the sump pressure over time;

obtaining a second derivative of the sump pressure curve; and identifying a local maximum of the second derivative of the sump pressure curve.

16. The method of claim 11, wherein determining that the wash fluid has reached the transition fill level comprises:

obtaining a sump pressure curve of the sump pressure over time; and determining that the sump pressure curve has a change of slope that falls below a predetermined lower threshold or exceeds a predetermined upper threshold.

17. The method of claim 14, wherein the sump pressure curve comprises a rolling queue of a predetermined number of most recent pressure measurements.

18. The method of claim 11, wherein determining the calibrated pressure of the wash fluid in the sump comprises using the following equation:

$$P_{CAL}=\text{Slope Correction Factor}\cdot P_{OUTPUT}+C_{OFFSET}$$

where: $P_{CAL}$=the calibrated sump pressure;

$C_{OFFSET}$=a constant, positive pressure;

$P_{OUTPUT}$=the measured transition pressure; and

Slope Correction Factor=a dimensionless constant.

* * * * *